US006676037B2

(12) United States Patent
Marks

(10) Patent No.: US 6,676,037 B2
(45) Date of Patent: Jan. 13, 2004

(54) ROTARY SHOWER NOZZLE

(76) Inventor: Kipley Roydon Marks, 61 St Heliers Bay Road, St. Heliers (NZ)

( * ) Notice: Subject to any disclaimer, the term of this patent is extended or adjusted under 35 U.S.C. 154(b) by 0 days.

(21) Appl. No.: 09/785,395

(22) Filed: Feb. 20, 2001

(65) Prior Publication Data

US 2001/0019083 A1 Sep. 6, 2001

(51) Int. Cl.[7] ..... B05B 3/04; B05B 3/16; B05B 3/00

(52) U.S. Cl. ..... 239/237; 239/240; 239/263; 239/264; 239/381

(58) Field of Search ..... 239/237, 240, 239/263, 264, 381, 383, 394

(56) References Cited

U.S. PATENT DOCUMENTS 3,865,310 A * 2/1975 Elkins et al. ..... 239/283
4,333,497 A * 6/1982 Busquets ..... 137/625.17
5,143,295 A * 9/1992 Okayama et al. ..... 239/403
5,332,155 A * 7/1994 Jager ..... 239/240
5,598,975 A * 2/1997 Jager ..... 239/327
5,685,487 A * 11/1997 Ellis ..... 239/261
5,857,623 A * 1/1999 Miller et al. ..... 239/252
6,113,005 A * 9/2000 Chih ..... 239/251
6,230,984 B1 * 5/2001 Jager ..... 239/225.1

* cited by examiner

*Primary Examiner*—Davis Hwu
(74) *Attorney, Agent, or Firm*—Young & Thompson

(57) ABSTRACT

A rotary spray nozzle is provided in a housing which has one or more water inlets that direct the incoming water flow in a direction tangential to the inner walls of the housing. This creates a circular or swirling motion of water within the housing which in turn imparts a rotary motion to the nozzle. The liquid or water in the housing exits the housing through the rotating nozzle to thereby provide a rotary spray.

35 Claims, 2 Drawing Sheets

FIG 2
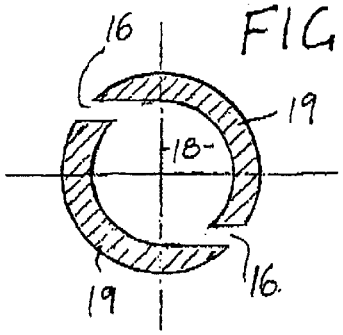
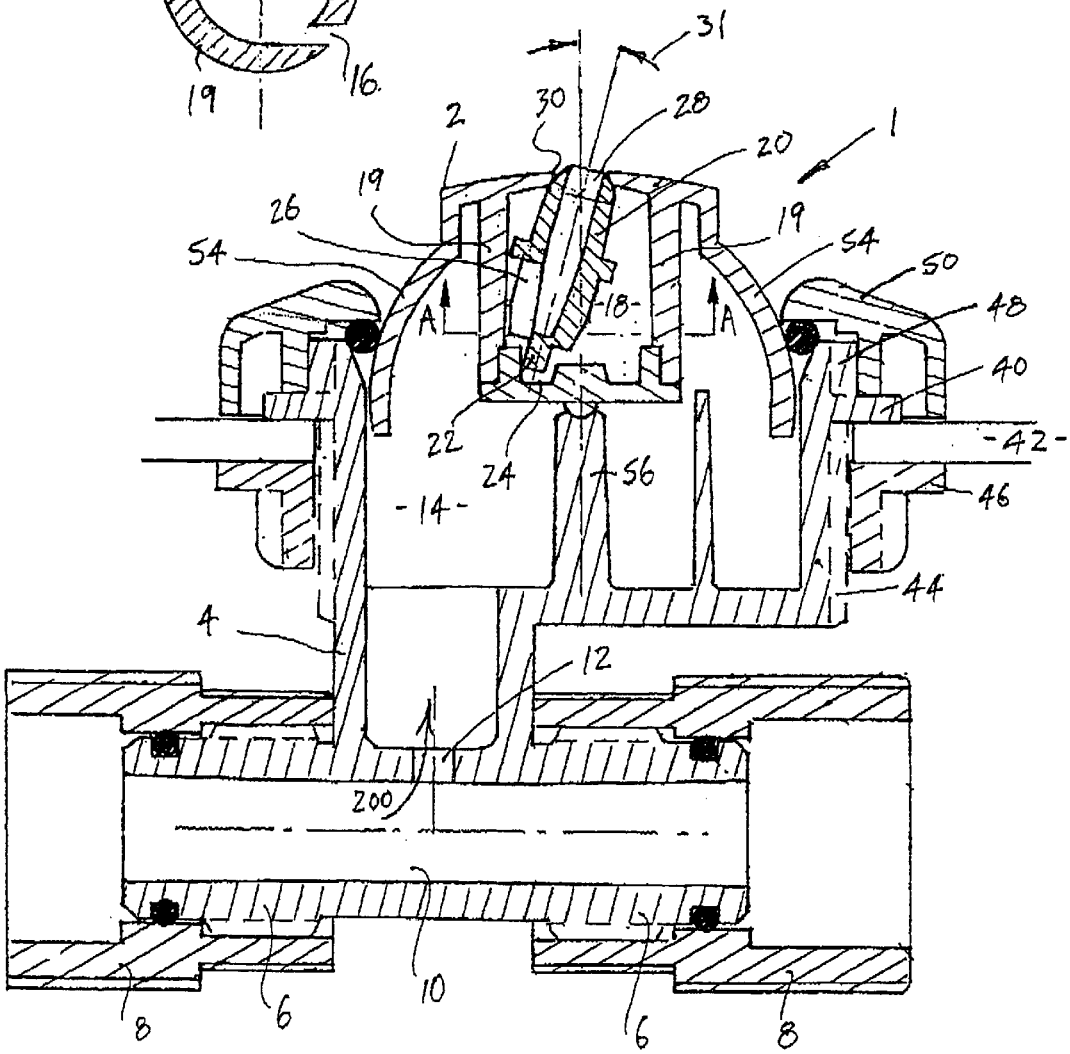
FIG 1

ROTARY SHOWER NOZZLE

FIELD OF INVENTION

This invention relates to rotary nozzle spray apparatus. The apparatus has been devised particularly, but not exclusively, for use as a rotary shower nozzle.

BACKGROUND OF THE INVENTION

Known rotary nozzle spray apparati have the disadvantages of being relatively complex and expensive to manufacture.

In particular, known constructions require the rotary nozzle to have either blades or a particular orientation in order to impart rotary motion to the nozzle. Also, the complexity of the known constructions tends to require substantial liquid inlet pressures to overcome frictional forces to allow the nozzle to operate effectively.

SUMMARY OF THE INVENTION

It is an object of the present invention to provide a rotary nozzle spray apparatus which will at least go some way toward overcoming the foregoing disadvantages or which will at least provide the public with a useful choice.

Accordingly, in one aspect the invention consists in rotary nozzle spray apparatus that includes a housing having walls, a housing outlet aperture, and housing inlet means to allow liquid to enter the housing. The apparatus has a rotary nozzle means supported within the housing, and the rotary nozzle means has a nozzle inlet to allow liquid in the housing to enter the rotary nozzle means, and a nozzle outlet to spray liquid from the apparatus through the housing outlet aperture. The housing inlet means directs liquid entering the housing in a direction substantially tangential to the walls of the housing. This creates a circular or swirling motion in the liquid in the housing so as to induce a rotational motion in the rotary nozzle means about a central axis of the housing.

A surface adjacent to the nozzle outlet in use bears against the surface adjacent to the housing outlet aperture to substantially prevent liquid escaping from the housing other than through the nozzle outlet means.

The housing preferably includes a nozzle guiding means to guide the nozzle so that it can rotate in the housing.

The rotary nozzle means preferably includes a housing guide means to further assist guidance of the nozzle relative to the housing.

The housing further includes a mounting element. The housing is also preferably selectively positionable relative to the mounting element.

The nozzle outlet is eccentric relative to the body of the rotary nozzle to provide a desired spray of liquid.

In a further aspect the invention consists in rotary nozzle spray apparatus including a housing having walls, a housing outlet aperture, and housing inlet means to allow liquid to enter the housing. The apparatus has a rotary nozzle means provided within the housing, and the rotary nozzle means has a nozzle inlet to allow liquid in the housing to enter the rotary nozzle means, and a nozzle outlet to spray liquid from the apparatus. A surface is provided adjacent to the nozzle outlet to in use bear against a surface adjacent to the housing outlet aperture under pressure of liquid within the housing to form a substantial seal between the nozzle outlet and the housing outlet.

The housing includes a nozzle guide means to guide the end of the rotary nozzle opposite the nozzle outlet in a substantially rotational motion in use about an axis of the housing.

The housing inlet means directs liquid entering the housing in a direction substantially tangential to the walls of the housing to create a circular or swirling motion in the liquid in the housing so as to induce a substantial rotational motion in the rotary nozzle means about a central axis of the housing.

The rotary nozzle means includes a housing guide means that interacts with the nozzle guide means.

The housing further includes a mounting element.

The housing is preferably selectively positionable relative to the mounting element.

The nozzle outlet is eccentric relative to the body of the rotary nozzle to provide a desired spray of liquid.

The invention may also broadly be said to consist in the parts, elements and features referred to or indicated in the specification of the application, individually or collectively, and any or all combinations of any two or more of the said parts, elements or features, and where elements or features are mentioned herein and which have known equivalents in the art to which this invention relates, such known equivalents are deemed to be incorporated herein as if individually set forth.

The invention consists of the forgoing and also envisages constructions of which the following gives examples.

DRAWING DESCRIPTION

One preferred form of the present invention will now be described with reference to the accompanying drawings in which;

FIG. 1 is a front elevation in cross section of a rotary nozzle spray apparatus in accordance in with the present invention;

FIG. 2 is a partial cross-section through line A—A of FIG. 1; and

DETAILED DESCRIPTION OF A PREFERRED EMBODIMENT

Figure 3:
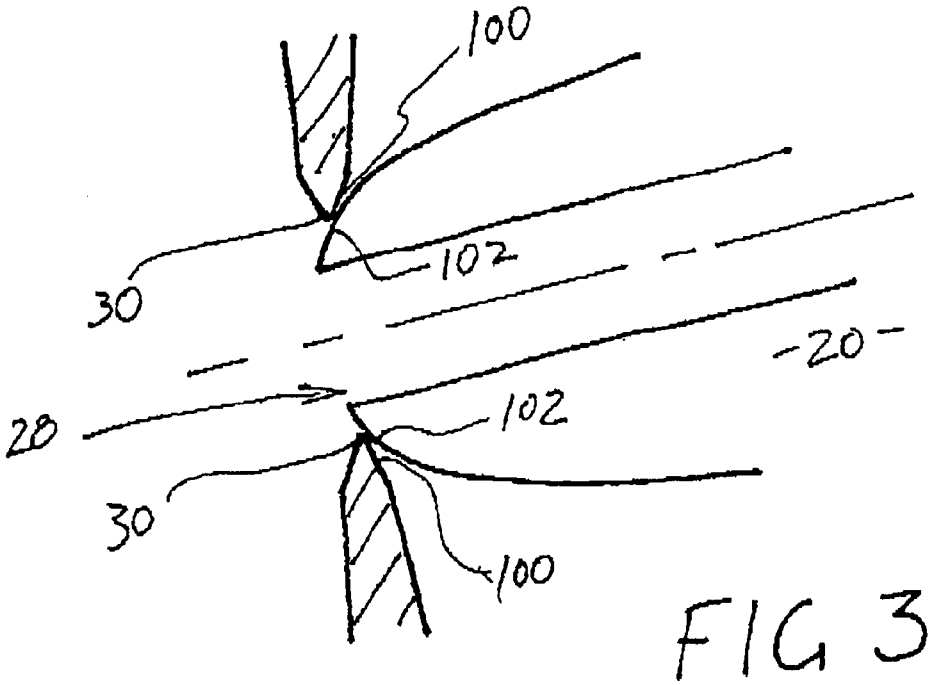
FIG. 3 is a partial front elevation in cross section of the rotary nozzle of FIG. 1 and part of the housing provided adjacent thereto.

Turning to FIG. 1, rotary nozzle spray apparatus in accordance with an embodiment of the present invention is shown generally referenced 1. The apparatus includes a housing 2 which is mounted relative to the mounting element 4 having male connectors 6 for connection to a liquid supply line (not shown). Each male connector 6 may have appropriate adaptors 8 to provide female connection if required. The connector 6 provides liquid communication with a liquid supply conduit 10 and inlet 12 of the mounting element. A hollow space 14 is provided within the element that in use contains liquid to be sprayed from the apparatus. At least one, and preferably two, inlets 16 are provided between space 14 and space 18 of the housing.

As can be seen with reference to FIG. 2, each inlet 16 is arranged so as to direct water entering space 18 in a direction substantially tangential to the inner cylindrical wall of space 18.

Turning again to FIG. 1, a rotary nozzle element 20 is provided within space 18. A guiding projecting pin 22 is provided at the base of the nozzle element and this in use travels within annular groove 24 of an end cap attached to the housing. The nozzle element 20 has a liquid inlet 26 and a nozzle outlet 28. The housing has an outlet aperture 30 adjacent to which the nozzle outlet 28 is disposed, as will be described further below.

The mounting element includes a flange 40 which is used to mount the apparatus in an aperture of a substantially planar member such as the wall 42 of a shower housing or other part of a shower installation (not shown). The element 4 has a threaded portion 44 which in use engages with a complementary thread on a nut 46 that is used to engage the mounting element with the wall portion 42.

The mounting element 4 has a further threaded portion 48 which is used to mount a trim member 50 that supports the housing 2. An O-ring 52 is provided between the housing 2, the trim member 50, and the mounting element 4, to provide a substantially water tight seal between these elements while at the same time allowing the housing to be adjustable. Therefore, the hemispherical walls 54 of housing 2 are able to be moved into and out of the mounting element portion to a limited extent dependent upon manipulation by a user. The housing 2 is supported by projection 56 of the mounting element.

Referring to FIG. 3, the relationship between the nozzle outlet 28 and aperture 30 of the housing 2 is shown in more detail. Referring to FIG. 3, it can be seen that the area of surfaces 100 which are adjacent the housing aperture 30 and surfaces 102 which are adjacent to the nozzle outlet 28 are configured so as to provide a minimal contact area therebetween.

The operation of the nozzle will now be described.

Referring again to FIG. 1, liquid from conduit 10 enters the support element 4 through inlet 12 as indicated by arrow 200. The liquid then travels through space 14 in the mounting element, then enters area 18 through aperture 16. As described above, aperture 16 is arranged so that the entry of water into area 18 is substantially tangential to the inner cylindrical surfaces of the walls 19, sufficient to impart a circular motion, or at least a swirling motion, to cause the rotational nozzle 20 to rotate within the housing about an axis of the housing.

The rotational nozzle 20, once subjected to the swirling motion of liquid within chamber 18, is guided in a circular motion within the housing by projection 22 being guided by annular groove 24.

Water pressure within chamber 18 maintains the surfaces 102 of the rotor (refer FIG. 3) in contact with inner surfaces 100 of the housing so as to form a substantial seal therebetween even though the rotor is moving relative to the housing. Furthermore, the minimal contact area of surfaces 100 and 102 results in minimal friction and thus reduces the risk of the rotor stalling. The minimal contact area can be achieved by making the nozzle diameter and the outlet diameter very similar to each other in sizes.

The liquid within area 18 of the housing enters the rotor through one or more entries 26 (refer FIG. 1) whereupon it is ejected from the nozzle 28.

As will be seen from the drawings, when the rotor 20 is rotating within the housing, liquid is ejected at an angle referenced 31 relative to the central axis of the housing. Angle 31 is preferably approximately 15° in use.

Therefore, the result is a spray of liquid from the nozzle 28 which rotates in a cone having an angle of approximately 30° at its apex. This provides a massaging effect to a user when the apparatus is mounted in a shower or similar installation.

In another embodiment of the invention, the nozzle 28 is provided eccentrically in the rotor. Because the rotor tends to rotate slowly about its central axis a spray pattern of "circles within circles" or epitrochoid pattern results.

The present invention has considerable advantages including:

The rotor construction is very simple. No bearings are required, so the need for any maintenance is virtually eliminated.

There is no elaborate apparatus required to make the nozzle rotate. The direction of water entry into the chamber in which the nozzle is located causes rotation.

The housing is adjustable relative to its mounting so that a range of adjustment is provided.

What is claimed is:

1. A bath shower spray nozzle for providing a massaging effect to the user, the spray nozzle including:

a chamber having walls, a chamber outlet aperture, and chamber inlet means to allow liquid from a bath shower plumbing of a bath shower installation to enter the chamber;

a rotary nozzle means supported within the chamber, the rotary nozzle means having a nozzle inlet to allow liquid in the chamber to enter the rotary nozzle means, and a nozzle outlet to spray liquid from the apparatus through the chamber outlet aperture to atmosphere;

wherein the chamber inlet means directs liquid entering the chamber in a direction substantially tangential to the walls of the chamber to create a circular motion in the liquid in the chamber so as to induce a substantial rotational motion in the rotary nozzle means about a central axis of the chamber;

the chamber inlet means being adapted for mounting to the bath shower installation;

and a wall of the chamber has a nozzle guide groove to guide the rotary nozzle means.

2. A bath shower spray nozzle as claimed in claim 1 wherein a surface adjacent to the nozzle outlet in use bears against a surface of the chamber adjacent to the chamber outlet aperture to substantially prevent liquid escaping from the chamber other than through the nozzle outlet means.

3. A bath shower spray nozzle as claimed in claim 1 wherein the rotary nozzle means comprises a rotary nozzle member and a projection is provided on the rotary nozzle member, the projection being adapted to be received in the nozzle guide groove.

4. A bath shower spray nozzle as claimed in claim 1 wherein the rotary nozzle means comprises a rotary nozzle member and the rotary nozzle member is eccentric relative to a central axis of the chamber.

5. A bath shower spray nozzle as claimed in claim 1 wherein the spray pattern provided by the bath shower spray nozzle is substantially conical in form.

6. A bath shower spray nozzle as claimed in claim 1 wherein the rotary nozzle means comprises a rotary nozzle member, and the nozzle outlet is eccentric relative to the body of the rotary nozzle member.

7. A bath shower spray nozzle as claimed in claim 6 wherein the spray pattern produced by the bath shower spray nozzle is an epitrochoidal pattern.

8. A bath shower spray nozzle for providing a massaging effect to a user, the spray nozzle including:

a chamber having walls, a chamber outlet aperture, and chamber inlet means to allow liquid to enter the chamber;

a rotary nozzle means provided within the chamber, the rotary nozzle means having a nozzle inlet to allow liquid in the chamber to enter the rotary nozzle means, and a nozzle outlet to spray liquid from the apparatus to the chamber outlet aperture to atmosphere;

wherein a surface adjacent to the nozzle outlet in use bears against the surface of the chamber adjacent to the chamber outlet aperture under pressure of liquid within the chamber to form a substantial seal therebetween;

and a wall of the chamber has a nozzle guide groove to guide the rotary nozzle means.

9. A bath shower spray nozzle as claimed in claim 8 wherein the rotary nozzle means comprises a rotary nozzle member and a projection is provided on the rotary nozzle member, the projection being adapted to be received in the nozzle guide groove.

10. A bath shower spray nozzle as claimed in claim 8 wherein the rotary nozzle means comprises a rotary nozzle member and the rotary nozzle member is eccentric relative to a central axis of the chamber.

11. A bath shower spray nozzle as claimed in claim 8 wherein the spray pattern provided by the bath shower spray nozzle is substantially conical in form.

12. A bath shower spray nozzle as claimed in claim 8 wherein the rotary nozzle means comprises a rotary nozzle member, and the nozzle outlet is eccentric relative to the body of the rotary nozzle member.

13. A bath shower spray nozzle as claimed in claim 12 wherein the spray pattern produced by the bath shower spray nozzle is an epitrochoidal pattern.

14. A bath shower spray nozzle for providing a massaging effect to the user, the spray nozzle including:

a chamber having walls, a chamber outlet aperture, and chamber inlet means to allow liquid from a bath shower plumbing of a bath shower installation to enter the chamber;

a rotary nozzle means supported within the chamber, the rotary nozzle means having a nozzle inlet to allow liquid in the chamber to enter the rotary nozzle means, and a nozzle outlet to spray liquid from the apparatus through the chamber outlet aperture to atmosphere;

wherein the chamber inlet means directs liquid entering the chamber in a direction substantially tangential to the walls of the chamber to create a circular motion in the liquid in the chamber so as to induce a substantial rotational motion in the rotary nozzle means about a central axis of the chamber;

the chamber inlet means being adapted for mounting to the bath shower installation;

a retaining flange for mounting the chamber to a wall of the bath shower installation;

and the chamber being selectively positionable within a predetermined range of movement relative to the retaining flange.

15. A bath shower spray nozzle as claimed in claim 14 wherein the shower installation includes a housing connected to the bathroom plumbing, the housing having a water supply cavity to supply water from the bathroom plumbing to the chamber inlet means.

16. A bath shower spray nozzle as claimed in claim 14 wherein the rotary nozzle means comprises a rotary nozzle member and the rotary nozzle member is eccentric relative to a central axis of the chamber.

17. A bath shower spray nozzle as claimed in claim 14 wherein the spray pattern provided by the bath shower spray nozzle is substantially conical in form.

18. A bath shower spray nozzle as claimed in claim 14 wherein the rotary nozzle means comprises a rotary nozzle member, and the nozzle outlet is eccentric relative to the body of the rotary nozzle member.

19. A bath shower spray nozzle as claimed in claim 18 wherein the spray pattern produced by the bath shower spray nozzle is an epitrochoidal pattern.

20. A bath shower spray nozzle for providing a massaging effect to a user, the spray nozzle including:

a chamber having walls, a chamber outlet aperture, and chamber inlet means to allow liquid to enter the chamber;

a rotary nozzle means provided within the chamber, the rotary nozzle means having a nozzle inlet to allow liquid in the chamber to enter the rotary nozzle means, and a nozzle outlet to spray liquid from the apparatus to the chamber outlet aperture to atmosphere;

wherein a surface adjacent to the nozzle outlet in use bears against the surface of the chamber adjacent to the chamber outlet aperture under pressure of liquid within the chamber to form a substantial seal therebetween;

a retaining flange for mounting the chamber to a wall of the bath shower installation;

and the chamber being selectively positionable within a predetermined range of movement relative to the retaining flange.

21. A bath shower nozzle as claimed in claim 20 wherein the shower installation includes a housing connected to the bathroom plumbing, the housing having a water supply cavity to supply water from the bathroom plumbing to the chamber inlet means.

22. A bath shower spray nozzle as claimed in claim 20 wherein the rotary nozzle means comprises a rotary nozzle member and the rotary nozzle member is eccentric relative to a central axis of the chamber.

23. A bath shower spray nozzle as claimed in claim 20 wherein the spray pattern provided by the bath shower spray nozzle is substantially conical in form.

24. A bath shower spray nozzle as claimed in claim 23 including a retaining flange for mounting the chamber to a wall of the bath shower installation;

and the chamber being selectively positionable within a predetermined range of movement relative to the retaining flange.

25. A bath shower spray nozzle as claimed in claim 24 wherein the shower installation includes a housing connected to the bathroom plumbing, the housing having a water supply cavity to supply water from the bathroom plumbing to the chamber inlet means.

26. A bath shower spray nozzle as claimed in claim 20 wherein the rotary nozzle means comprises a rotary nozzle member, and the nozzle outlet is eccentric relative to the body of the rotary nozzle member.

27. A bath shower spray nozzle as claimed in claim 26 wherein the spray pattern produced by the bath shower spray nozzle is an epitrochoidal pattern.

28. A bath shower spray nozzle for providing a massaging effect to the user, the spray nozzle including:

a chamber having walls, a chamber outlet aperture, and chamber inlet means in a side wall of the chamber to allow liquid from a bath shower plumbing of a bath shower installation to enter the housing;

a rotary nozzle means supported within the chamber, the rotary nozzle means having a nozzle inlet in a side wall of the nozzle to allow liquid in the chamber to enter the rotary nozzle means, and a nozzle outlet to spray liquid from the apparatus through the chamber outlet aperture to atmosphere;

wherein the chamber inlet means directs liquid entering the chamber in a direction substantially tangential to the walls of the chamber to create a circular motion in the liquid in the chamber so as to induce a substantial rotational motion in the rotary nozzle means about a central axis of the chamber;

the chamber inlet means being adapted for mounting to the bath shower installation.

29. A bath shower spray nozzle as claimed in claim 28 wherein a wall of the chamber has a nozzle guide groove to guide the rotary nozzle means.

30. A bath shower spray nozzle as claimed in claim 29 wherein the rotary nozzle means comprises a rotary nozzle member and a projection is provided on the rotary nozzle member, the projection being adapted to be received in the nozzle guide groove.

31. A bath shower spray nozzle as claimed in claim 28 wherein a surface adjacent to the nozzle outlet in use bears against a surface of the chamber adjacent to the chamber outlet aperture to substantially prevent liquid escaping from the chamber other than through the nozzle outlet means.

32. A bath shower spray nozzle as claimed in claim 28 wherein the rotary nozzle means comprises a rotary nozzle member and the rotary nozzle member is eccentric relative to a central axis of the chamber.

33. A bath shower spray nozzle as claimed in claim 28 wherein the spray pattern provided by the bath shower spray nozzle is substantially conical in form.

34. A bath shower spray nozzle as claimed in claim 28 wherein the rotary nozzle means comprises a rotary nozzle member, and the nozzle outlet is eccentric relative to the body of the rotary nozzle member.

35. A bath shower spray nozzle as claimed in claim 34 wherein the spray pattern produced by the bath shower spray nozzle is an epitrochoidal pattern.

* * * * *